US007274176B2

(12) United States Patent
Mihara

(10) Patent No.: US 7,274,176 B2
(45) Date of Patent: Sep. 25, 2007

(54) REGULATOR CIRCUIT HAVING A LOW QUIESCENT CURRENT AND LEAKAGE CURRENT PROTECTION

(75) Inventor: Masaaki Mihara, Chuo-ku chiba (JP)

(73) Assignee: STMicroelectronics KK (JP)

( * ) Notice: Subject to any disclaimer, the term of this patent is extended or adjusted under 35 U.S.C. 154(b) by 236 days.

(21) Appl. No.: 10/999,358

(22) Filed: Nov. 29, 2004

(65) Prior Publication Data

US 2006/0113972 A1 Jun. 1, 2006

(51) Int. Cl.
*G05F 1/59* (2006.01)

(52) U.S. Cl. ..... 323/269; 323/274

(58) Field of Classification Search ..... 323/224, 323/226, 269, 270, 274
See application file for complete search history.

(56) References Cited

U.S. PATENT DOCUMENTS 3,509,448 A * 4/1970 Bland ..... 323/269
4,684,877 A * 8/1987 Shreve et al. ..... 323/269
4,779,037 A * 10/1988 LoCascio ..... 323/275
5,025,203 A * 6/1991 Edwards ..... 323/268
5,280,233 A * 1/1994 Poletto et al. ..... 323/269
5,528,127 A * 6/1996 Streit ..... 323/269
5,828,205 A * 10/1998 Byrne ..... 323/268
6,222,353 B1 * 4/2001 Pattamatta et al. ..... 323/269
6,469,480 B2 * 10/2002 Kanakubo ..... 323/269
6,677,735 B2 * 1/2004 Xi ..... 323/273
6,677,737 B2 * 1/2004 Hamon et al. ..... 323/280
6,696,822 B2 * 2/2004 Takabayashi ..... 323/224
6,806,690 B2 * 10/2004 Xi ..... 323/273
6,967,470 B2 * 11/2005 Takabayashi ..... 323/224
7,106,032 B2 * 9/2006 Chen et al. ..... 323/269

* cited by examiner

*Primary Examiner*—Jeffrey Sterrett
(74) *Attorney, Agent, or Firm*—David V. Carlson; Lisa K. Jorgenson

(57) ABSTRACT

A voltage regulator includes first and second transistors arranged in parallel and configured to regulate current flow to an output node, and a sensing circuit configured to sense a voltage level at the output node and provide a signal proportional thereto. the regulator also includes a control circuit configured to receive the signal from the sensing circuit and provide control signals at control terminals of the first and second transistors such that voltage at the output node is maintained substantially at a selected level. The control circuit further configured to hold the second transistor in an off state while a demand for current at the output node remains below an output threshold. The second transistor is configured to control a large portion of load current above the output threshold. The regulator may also include a current bypass circuit configured to shunt leakage current of the second transistor to ground, away from the sensing circuit.

44 Claims, 12 Drawing Sheets

REGULATOR CIRCUIT HAVING A LOW QUIESCENT CURRENT AND LEAKAGE CURRENT PROTECTION

BACKGROUND OF THE INVENTION

1. Field of the Invention

The present invention relates to a voltage regulator circuit, and in particular, to a circuit having a low quiescent current, and high stability at high temperatures.

2. Description of the Related Art

Voltage regulator circuits are found in most electronic devices in use today. Such circuits are configured to receive, at an input, an unregulated voltage supply, and to provide, at an output, a regulated voltage at a selected voltage level, lower than the input. Such circuits are commonly used, for example, in devices that are powered by batteries, in order to maintain a steady voltage supply for the device, even as the output voltage of the battery gradually drops due to normal discharge of the battery. Voltage regulator circuits are also found in systems requiring a voltage supply at one voltage level but where power is available at a different voltage level.

Voltage regulator circuits typically require some power to operate. For example, such circuits employ reference voltage generators, voltage sensing sub-circuits, and other sub-circuits that remain active while the regulator circuit is powered up, even when there is no load on the output. As a result, the regulator circuit will draw a current from the power supply, regardless of the load. This current is commonly referred to as the quiescent current.

In a battery operated system such as that described, the quiescent current represents a constant drain on the battery, as long as the system is active. Accordingly, it would be desirable, especially in a battery powered system, to turn off the regulator when there is no load present. However, this is not always possible. In some applications, it is necessary to maintain a voltage level at the output even while there is minimal current draw. For example, some systems maintain a clock, a volatile memory, or some other circuit that has negligible power requirements, but must have a continuous voltage supply. Such circuits are found, for example, in automobiles, where various systems remain nominally active, perpetually, even while the automobile is not in operation.

For example, a typical automobile audio system maintains a memory of radio settings, etc., which are stored in a volatile memory, such that if the power is disconnected the memory is erased. In addition, modern automobiles employ computers, which similarly must be kept powered to maintain data in memory. Each such system will employ a separate regulator circuit, such that the quiescent current draw on the battery may be multiplied many times. Some modern automobiles may include a dozen or more such systems.

In view of the above, it is desirable to reduce the quiescent current of each voltage regulator circuit, in order to minimize the drain that the sum of the quiescent currents represents on the battery.

BRIEF SUMMARY OF THE INVENTION

According to an embodiment of the invention, a voltage regulator is provided, including an output node configured to be coupled to a load circuit, a first power transistor having a first conduction terminal coupled to a voltage source and a second conduction terminal coupled to the output node, a second power transistor having a first conduction terminal coupled to the voltage source and a second conduction terminal coupled to the output node, and a control circuit configured to sense an output voltage at the output node and provide control signals to each of the power transistors. The control circuit is configured to control a conduction capacity of each of the first and second power transistors such that the output voltage remains approximately equal to a selected output voltage. The control circuit is further configured to hold the second transistor in an off state unless a load current drawn from the output node exceeds a threshold current.

The control circuit comprises first and second biasing transistors coupled between a circuit ground and respective control terminals of the first and second power transistors and configured to regulate biasing currents of the respective power transistors first and second constant current sources are coupled between the voltage source and respective control terminals of the first and second power transistors.

Additionally, a biasing resistor circuit is coupled between the voltage source and the control terminal of the second power transistor. The biasing resistor circuit, which includes the second constant current source, is configured to at least partially suppress a biasing current passing therethrough while the load current does not exceed the threshold current.

According to one embodiment of the invention, the biasing resistor circuit includes a biasing resistance coupled between the voltage source and the control terminal of the second power transistor and parallel to the second constant current source. The biasing resistance is variable in inverse response to a level of current flowing therethrough.

According to another embodiment of the invention, a voltage regulator is provided, including a first transistor formed on a semiconductor substrate and having first and second conduction terminals coupled to a first voltage source and an output node of the regulator, respectively, and a control circuit configured to monitor a voltage level at the output node and provide a control signal at a control terminal of the first transistor so as to maintain the voltage level at a selected value. The regulator further includes second, third, and fourth transistors.

A first conduction terminal of the second transistor is coupled to the first voltage source, and, according to an embodiment of the invention, the second transistor is permanently biased in an off state. The third transistor is coupled in diode configuration between a second conduction terminal of the second transistor and a second voltage source—circuit ground, for example. The fourth transistor is coupled between the output node and the second voltage source, with a control terminal coupled to a control terminal of the third transistor such that the fourth transistor is configured to mirror current flow of the third transistor. The fourth transistor is configured to mirror the current of the third transistor at a rate such that current flowing in the fourth transistor is substantially equal to leakage current flowing in the first transistor.

According to one embodiment of the invention, the second transistor is configured to leak current at a selected ratio, relative to the first transistor, across a selected range of temperatures. The ratio may be, for example, approximately 1:100. Additionally, the fourth transistor may be configured to mirror a current flowing in the third transistor at a ratio substantially reciprocal to the leakage current ratio of the second transistor relative to the first transistor. For example the current mirror ratio of the fourth transistor, relative to the third transistor, may be approximately 100:1.

Alternatively, the current mirror ratio of the fourth transistor, relative to the third transistor, may be selected to result in a mirror current that exceeds the leakage current of the first transistor.

BRIEF DESCRIPTION OF THE SEVERAL VIEWS OF THE DRAWING(S)

DETAILED DESCRIPTION OF THE INVENTION

Figure 1:
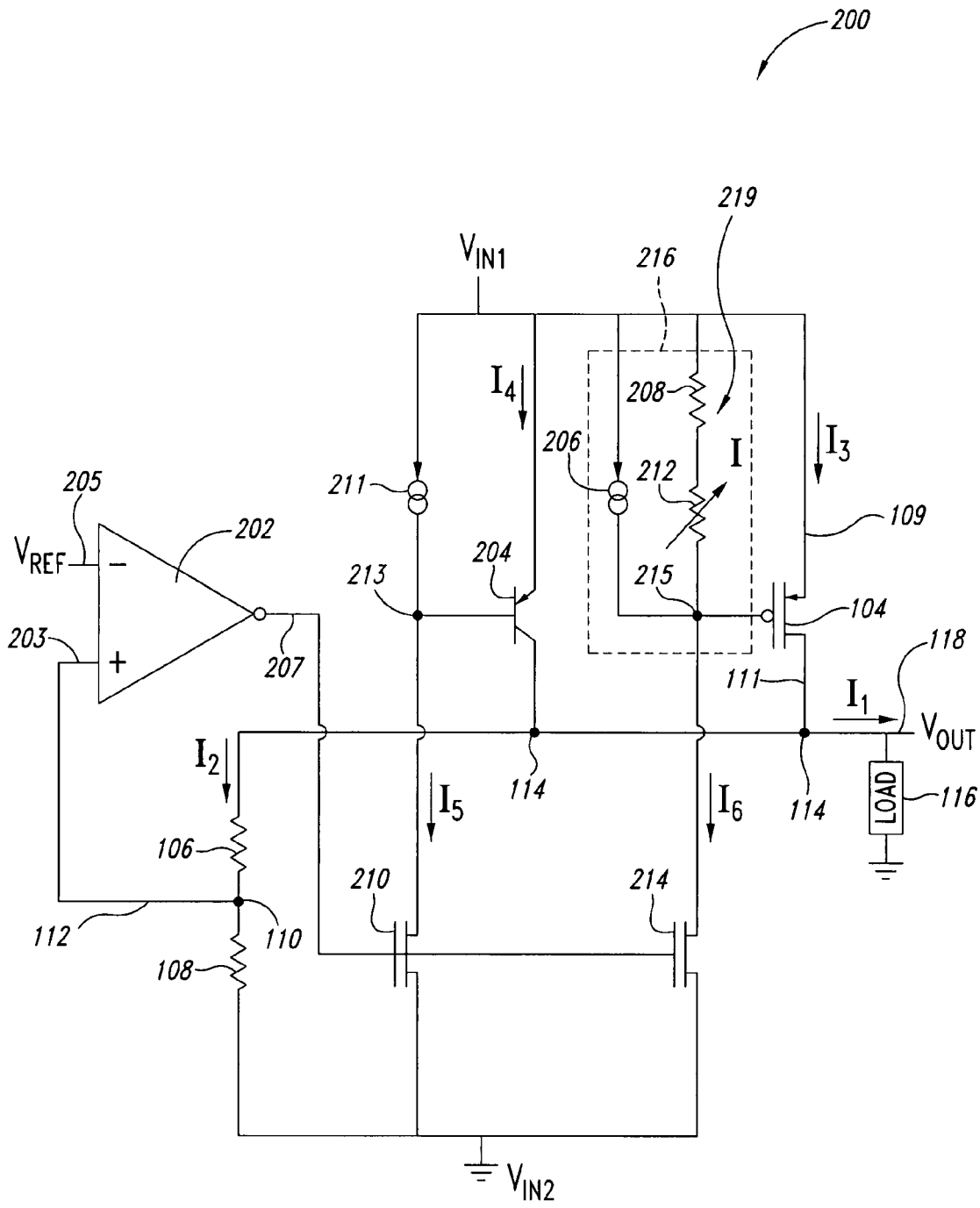
FIG. 1 illustrates a voltage regulator according to an embodiment of the invention.

A voltage regulator 200 according to a first embodiment of the invention is shown in FIG. 1. The voltage regulator 200 of FIG. 1 is a simplified diagram showing only those components necessary to describe and understand the function thereof.

In the circuit of FIG. 1, a first voltage source $V_{IN1}$ corresponds to the positive terminal of a battery, while a second voltage source $V_{IN2}$ corresponds to the negative terminal of the battery, or the circuit ground. It will be recognized that this arrangement is only one of many possible configurations, illustrated here as an example, only.

The voltage regulator 200 includes a power transistor 104 having a first conduction terminal 109 coupled to the first voltage source $V_{IN1}$, and a second conduction terminal 111 coupled to an output node 114. A load circuit 116 is coupled to the output node 114 via output terminal 118, and output voltage $V_{OUT}$ at the node 114 is regulated by the power transistor 104.

First and second sense resistors 106, 108 are coupled in series between the output node 114 and the second voltage source $V_{IN2}$, with a feedback node 110 defined therebetween. A comparator 202 includes a non-inverting input 203 coupled to the feedback node 110 via feedback line 112, an inverting input 205 coupled to a reference voltage source $V_{REF}$. The comparator 202 also includes an inverting output 207.

The resistance values of the first and second resistors 106, 108 are selected such that, when the voltage level at the output node 114 is equal to the selected regulated output voltage $V_{OUT}$ of the regulator 200, a voltage level at the feedback node 110 is equal to the reference voltage $V_{REF}$.

For example, the voltage regulator 200 may be configured to provide a regulated voltage of around 5 volts at the output node 114, and may employ a reference voltage of 1.26 volts. Accordingly, the values of the first and second resistors 106, 108 are selected such that, when the 5 volt regulated voltage is divided across the voltage divider formed by the first and second resistors 106, 108, the voltage at the feedback node 110 is equal to the reference voltage, 1.26 volts. If resistor 106 is equal to 1.5 MΩ and resistor 108 is equal to 500 KΩ, such a condition is realized. Of course, it will be recognized that these are only exemplary values, and are not intended to represent a particular working circuit.

Reference voltage sources suitable for use with a circuit of this type are well known in the art. For example, a band-gap reference voltage may be employed as the reference voltage source $V_{REF}$.

The inverted output 207 of the comparator 202 is connected to the control terminal of a first biasing transistor 210, which is connected in series with the current source 214 between voltage sources $V_{IN1}$ and $V_{IN2}$. Control node 213 is positioned between the control transistor 210 and the current source 214. PNP bipolar transistor 204 is coupled between the first voltage source $V_{IN1}$ and the output node 114 with the base thereof coupled to the control node 213.

The output 207 of the comparator 202 is also connected to the control terminal of a second biasing transistor 214. The biasing transistor 214 is coupled in series with a biasing resistor circuit 216 between the first and second voltage sources $V_{IN1}$, $V_{IN2}$, with control node 215 located between the biasing resistor circuit 216 and the bias control transistor 214. The control terminal of the power transistor 104 is coupled to the control node 215.

Comparator 202 is configured to provide an output voltage at output 207 that increases as the voltage potential at the non-inverting input 203 drops below that of the inverting input 205. Conversely, when the voltage at the non-inverting input 203 is equal to, or greater than, the voltage potential at the inverting input 205, the output of the comparator 202 is at a selected low voltage level. The low voltage level of the output 207 is selected such that the bias control transistors 210, 214 are each maintained at a conduction level sufficient to conduct the current provided by the constant current sources 211, 206. Configuration of a comparator to provide such a low voltage level is within the abilities of one having ordinary skill in the art, and will not be discussed in detail herein.

For the purposes of describing operation of the regulator circuit 200, it will be assumed at the outset that the power transistors 104, 204 are in an off, or non-conducting state, and that output 207 of the comparator 202 is at its low voltage level. In this condition, all of the source voltage $V_{IN1}$ is seen across the power transistors 104, 204 and the voltage potentials at the output node 114 and the feedback node 110 are both equal to the circuit ground. With the voltage at the non-inverting input 203 equal to ground, the higher reference voltage at the inverting input 205 will cause the inverted output 207 of the comparator 202 to move in a positive direction. As the voltage level at the control terminals of the bias control transistors 210, 214 rises, the conduction level of these transistors rises.

Referring first to bias control transistor 210, as bias current $I_5$ increases above the current level of constant current source 211, the voltage at node 213 drops, which in turn causes PNP transistor 204 to begin to conduct through current path $I_4$. A portion of this current is expressed as an emitter-base current and joins the bias current $I_5$ to provide the additional current flowing through bias control transistor 210. The majority of the current flowing through power transistor 204 is transmitted to node 114 in accordance with the gain characteristics of transistor 204. At this point the current is divided between load current $I_1$ flowing through the load 116, and sense current $I_2$ flowing through the sense resistors 106,108. The current in current paths $I_1$ and $I_2$ is divided according to known principles, and depends upon resistances in the respective current paths. As current $I_2$ flows through the sense resistors 106, 108, the voltage at the feedback node 110 begins to rise. Provided the sense current $I_2$ is sufficient to create a voltage drop across sense resistor 108 substantially equal to the voltage level at the inverting input 205 of the comparator 202, the circuit will reach equilibrium when the voltage drop across both sense resistors 106,108 rises to the selected output voltage. It may be seen that the power transistor 204 will begin to conduct current as soon as the conduction capacity of the bias control transistor 210 rises above the current level established by the constant current source 211. Accordingly, the power transistor 204 responds very quickly to small imbalances in the circuit. The power transistor 204 may be configured to have a relatively low current capacity.

In the example provided above, resistor 106 is equal to 1.5 MΩ and resistor 108 is equal to 500 KΩ, and the regulated voltage $V_{OUT}$ is 5V. Given these values, the sense current $I_2$ will be 2.5 μA. Under no load conditions, in may be seen that a very low base current in power transistor 204 will be sufficient to provide an acceptable sense current $I_2$. For example, in order to provide sufficient current to maintain the sense current $I_2$ at 2.5 μA, and given a gain factor of 100, transistor 204 will have a base current of 0.025 μA. Thus, the bias control transistor 210 only needs to increase conduction above the 1 μA of constant current source 211 by that amount.

According to the embodiment of FIG. 1, the capacity of power transistor 204 is sufficient to provide the sense current $I_2$ and some additional load current $I_1$. Under these conditions, the power transistor 104 is configured to remain in an off state, as will be described in detail below. Current $I_2$ flows continuously, regardless of the load on the regulator 200, and contributes to the quiescent current of the circuit.

Referring now to the bias control transistor 214, this transistor is in series with the biasing resistor circuit 216. When the output 207 of the comparator 202 is at its low voltage level, the conduction capacity of the transistor 214 is less than, or equal to, the current flowing in the constant current source 206. As with the bias control transistor 210 and the constant current source 211, the current source 206 provides a very low bias current $I_6$, which generates a voltage drop across bias control transistor 214, thereby maintaining a high voltage value at node 215, which in turn holds the power transistor 104 in an off condition. As the voltage at the output 207 of the comparator 202 begins to rise, the current carrying capacity of the transistor 214 increases. When the current capacity of the transistor 214 exceeds the current flow of the constant current source 206, current begins to flow in the resistor network formed by the resistor 208 and the variable resistor 212. The variable resistor 212 is configured to vary in resistance in inverse relation to the current flowing therethrough. Accordingly, at very low current levels, the value of resistor 212 is very high.

When the output 207 of the comparator 202 is at a low voltage level, the conduction capacity of the transistor 214 is equal to or less than the current value of the constant current source 206. Accordingly, the voltage level at node 215 is very nearly equal to the voltage of the first voltage source $V_{IN1}$, and the resistance of the resistance circuit 216 is nearly zero, being dominated by the output impedance of the constant current source 206, and all the voltage in the circuit is seen across the bias control transistor 214. As soon as the current capacity of the bias control transistor 214 rises above the current level of the constant current source 206, the resistance of the resistance circuit 216 rises sharply, thereby partially suppressing the increase in bias current $I_6$. At this point, the majority of the voltage is still seen across the bias control transistor 214, and the power transistor 104 remains in an off state.

Inasmuch as the bias current $I_6$ contributes to the quiescent current of the regulator circuit 200, the suppression of the increase thereof, at low output current levels, helps minimize the total quiescent current of the circuit.

If the load current $I_1$ is minimal, the power transistor 104 does not turn on, and the regulator circuit stabilizes with the power transistor 204 providing the necessary current. However, if the load current $I_1$ is sufficiently high, voltage at the feedback node 110 remains below the reference voltage, voltage at the output 207 of the comparator 202 continues to rise, and the current capacity of the bias control transistor 214 also continues to rise.

As the current capacity of the bias control transistor 214 continues to rise, the current through the variable resistor 212 increases, and the resistive value of this resistor decreases. This serves to reduce the rate of change of voltage at the node 215, and to delay turn-on of power transistor 104. Thus, for low current requirements, power transistor 104 remains in an off condition while power transistor 204 provides the necessary current. At the same time, bias current $I_6$ is held at a low value by the initially high resistance of the resistance circuit 216.

Eventually, as current $I_6$ continues to increase, the variable resistor 212 reaches a negligible resistance value and the voltage difference between first and second voltage sources $V_{IN1}$ and $V_{IN2}$ is substantially divided between resistor 208 and bias control transistor 214. Thereafter, as current capacity of the bias control transistor 214 continues to increase, the voltage at node 215 drops in a linear fashion, and power transistor 104 begins to conduct current $I_3$.

When a load 116 is connected to the output terminal 118, current path $I_1$ conducts, drawing off a portion of the current $I_4$ from the current path $I_2$, causing the voltage across the first and second resistors 106, 108 to begin to drop. As the voltage at the feedback node 110 begins to drop below the reference voltage $V_{REF}$, the output 107 of comparator 202 begins to rise, inducing the transistor 204 to increase conduction until the balance between the voltage at the feedback node 110 and the reference voltage is restored.

If the load current $I_1$ rises to near the capacity of transistor 204, sense current $I_2$ is drawn down, the voltage at output 207 of comparator 202 rises, increasing conduction of bias control transistor 214, pulling down voltage at node 215, and power transistor 104 begins to conduct current $I_3$ as described above, and current output $I_1$ of the voltage regulator 200 increases until equilibrium is restored. In this way, the voltage regulator 200 maintains a substantially steady output voltage $V_{OUT}$, regardless of the size of the load 116, up to the capacities of the power transistors 204 and 104, and the voltage source $V_{IN1}$. This is accomplished while maintaining a very low quiescent current level, especially under low-load conditions.

The threshold at which power transistor 104 begins to conduct is a design consideration controlled by factors such as the capacity and gain factor of transistor 204, turn-on voltage of transistor 104, and the response parameters of the variable resistor 212, as well as many other variables that one of ordinary skill will recognize. The threshold may be expressed in reference to various parameters, including the output current $I_1$, the output voltage $V_{OUT}$, voltage at the feedback node 110, the bias current $I_6$, or the voltage at comparator output 207.

Figure 2:
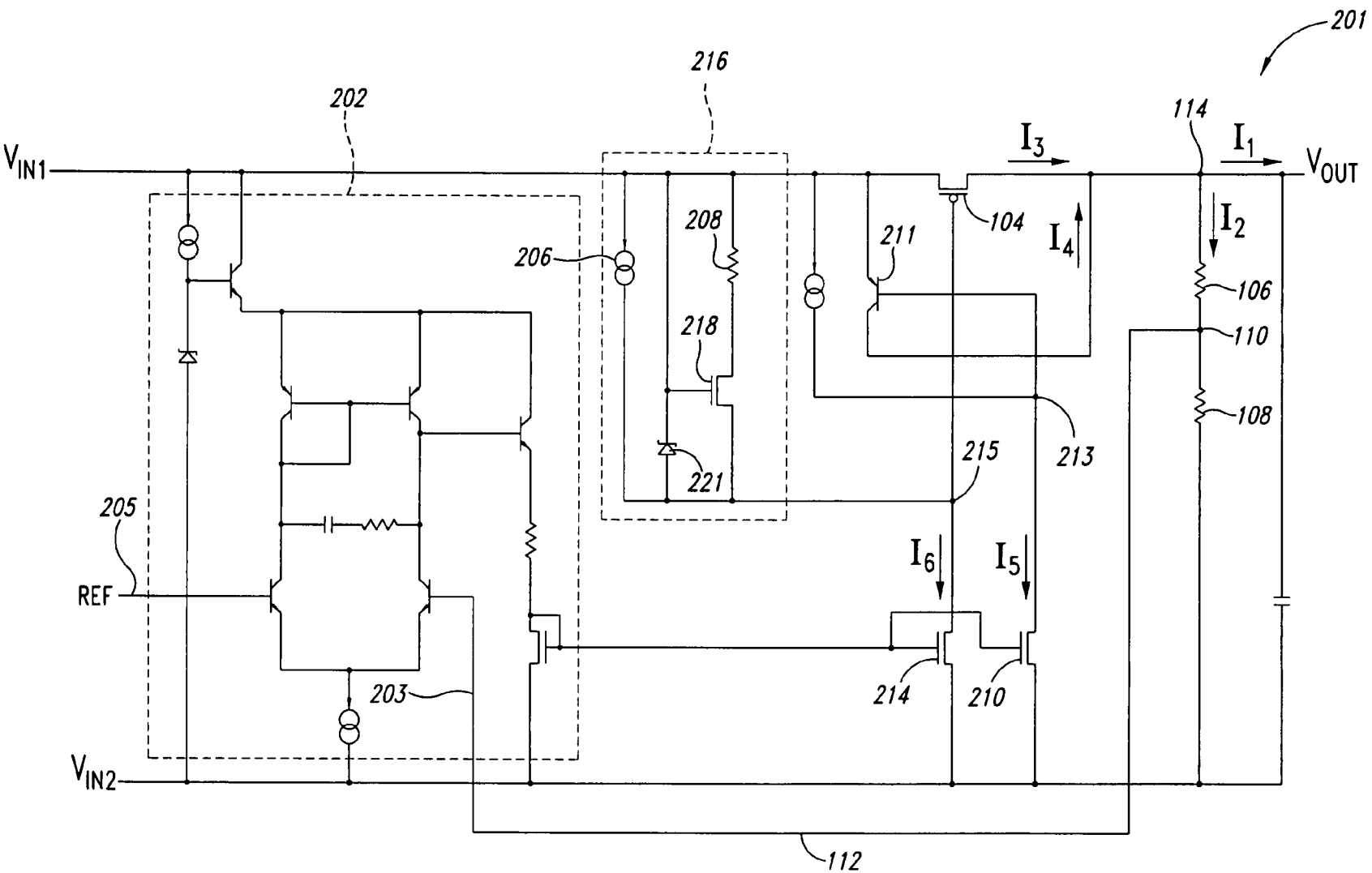
FIG. 2 illustrates a voltage regulator according to another embodiment of the invention.

Referring now to FIG. 2, a voltage regulator 201 is shown incorporating many of the features of the voltage regulator 200 of FIG. 1, and providing increased detail with respect to the circuitry of the comparator 202 and the biasing circuit 216.

Referring, in particular, to the biasing resistor circuit 216, it may be seen that the current control resistor 212 is represented by an NMOS transistor 218 having a control terminal tied to the first voltage source $V_{IN1}$. In this configuration, the transistor 218 will function substantially as a diode connected transistor. While the conduction capacity of the bias control transistor 214 remains at less than, or equal to, the current value of the constant current source 206, virtually all of the voltage of the network will be seen across the bias control transistor 214, such that the voltage potential at the control terminal of the power transistor 104 will be maintained at a voltage level very nearly equal to the voltage at the first voltage source $V_{IN1}$. Consequently, the power transistor 104 will be in a full off state. As the current capacity of the bias control transistor 214 increases, current will begin to flow through the resistor 208 and transistor 218, and the voltage level at the node 215 will begin to rise. However, as described with reference to the current controlled resistor 212 of FIG. 1, as the transistor 218 begins to conduct current, the resistance across this transistor will drop, partially offsetting the drop of resistance across the bias control transistor 214, which will in turn delay a significant drop of voltage at the node 215, thereby delaying turn-on of the power transistor 104. During this delay, power transistor 204 will begin to conduct, as described previously. Once transistor 218 is in a full on condition, the voltage at node 215 will drop in a linear fashion with respect to the rise in current $I_6$, as more and more of the voltage will be seen across transistor 208.

According to an embodiment of the invention, a zener diode 221 is provided between the control and output terminals of transistor 218.

Figure 3:
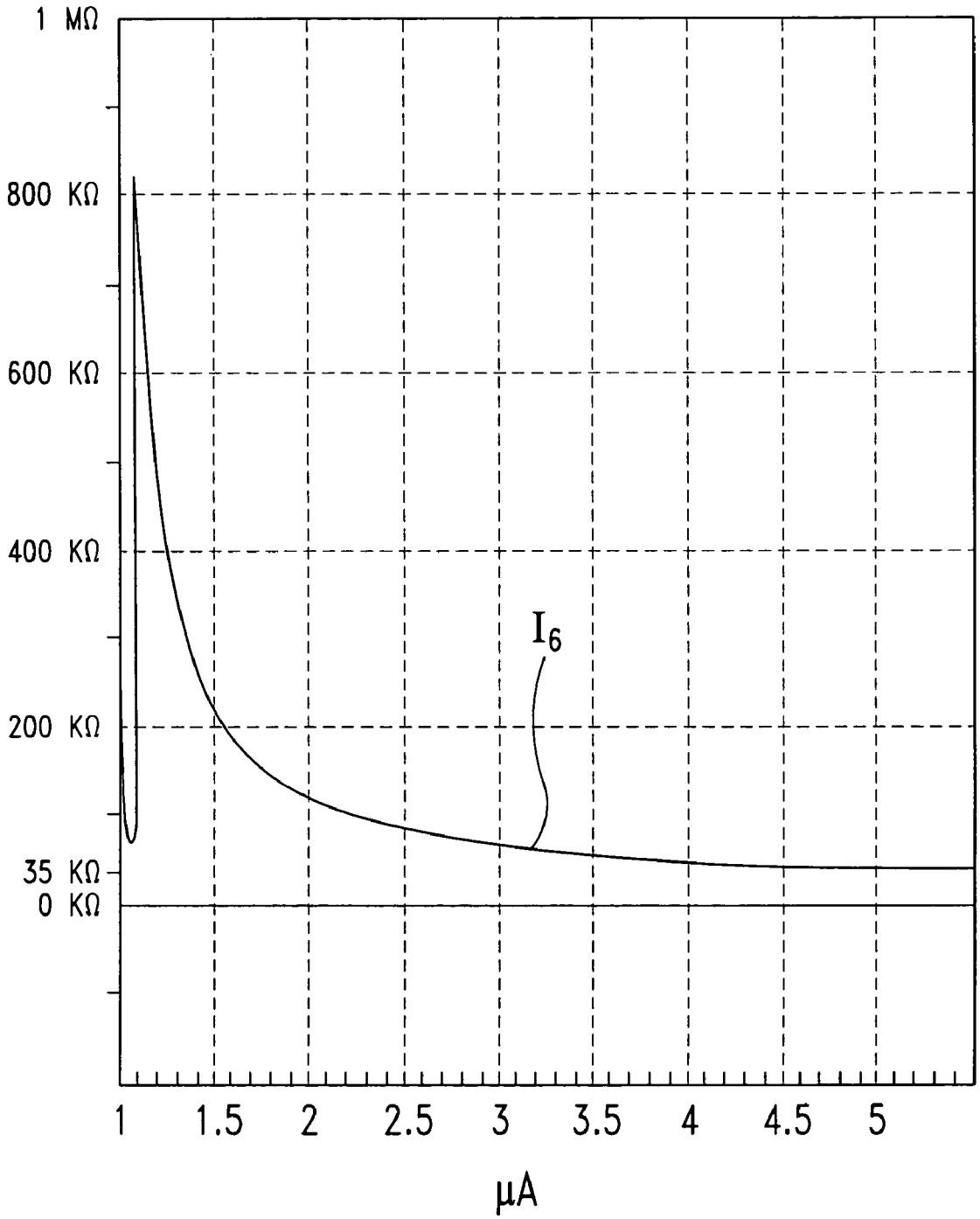
FIG. 3 is a graph illustrating a relationship between current and resistance in a component of the embodiment of FIG. 2.

Referring now to FIG. 3, a chart plotting the resistance seen across the resistor series 216 comprising resistor 208 and transistor 218 in relation to the current flowing in current path $I_6$ is shown. It may be seen that, when the current flowing in $I_6$ exceeds the value of the constant current source 206 of 1 μA, the resistance of resistor series 216 jumps from around 70 KΩ to around 800 KΩ. As $I_6$ continues to increase, R 216 drops until the value of R 216 is substantially equal to the 35 KΩ of the resistor 208.

An advantage of the embodiments described with reference to FIGS. 1 and 2 is the extremely low quiescent current when there is little or no load on the circuit. For example, according to one embodiment of the invention, each of the constant current sources 206, 211, is configured to generate a current of about 1 μA each. Additionally, the biasing resistor circuit 216 serves to hold the bias current $I_6$ at a low level under low-load conditions. Given sense resistors 106, 108 of 1.5 MΩ and 500 KΩ, respectively, and a $V_{OUT}$ of around 5 volts, the sense current $I_2$ is around 2.5 μA. The reference voltage source $V_{REF}$ and the comparator 202 will each draw a current as well. In total, the quiescent current is around 6-8 μA.

Figure 4:
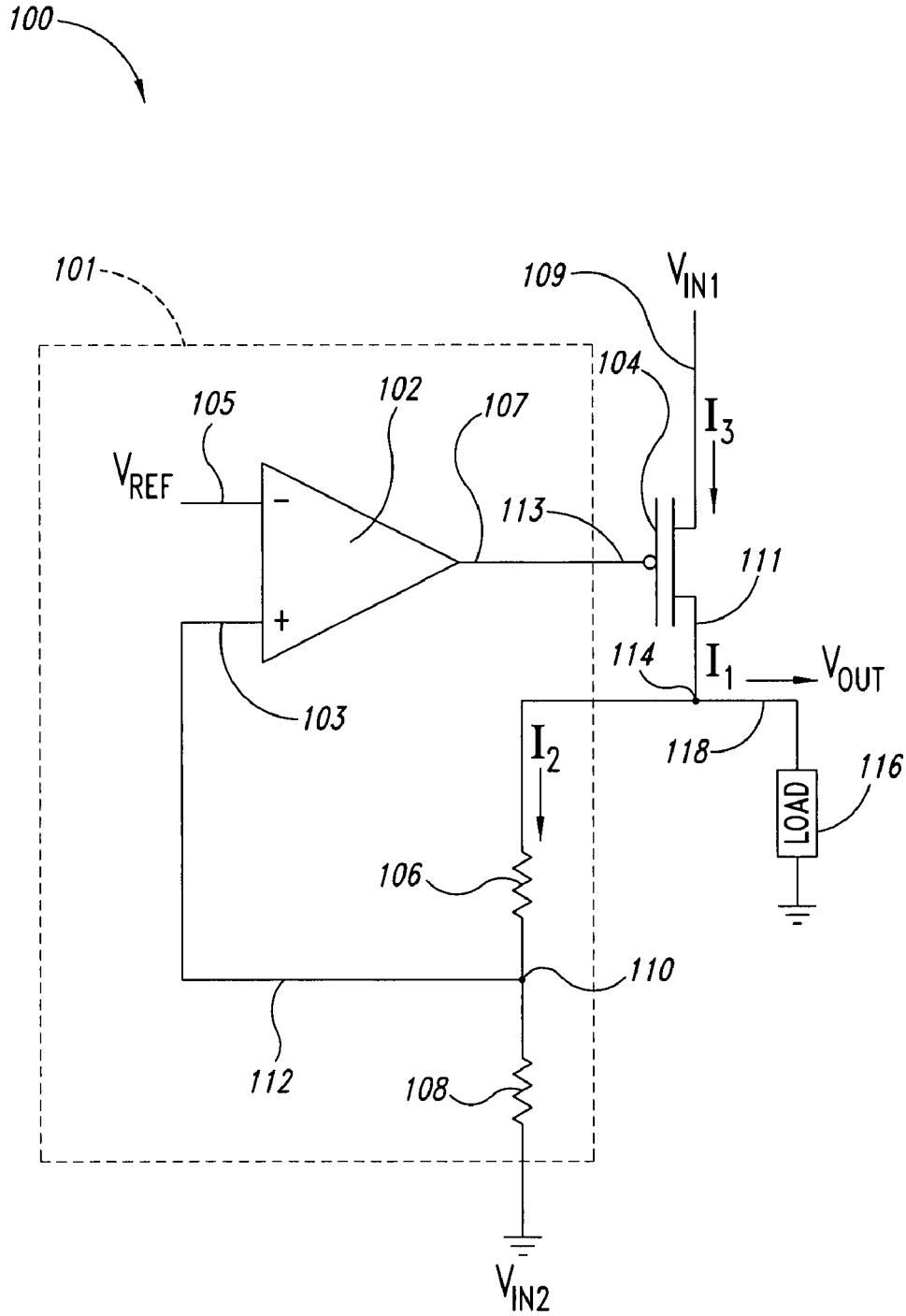
FIG. 4 illustrates a simplified voltage regulator for descriptive purposes.

Referring now to FIG. 4, a simplified voltage regulator circuit 100 is illustrated for the purpose of explaining complications that may arise in some applications of low quiescent current circuits such as those described with reference to FIGS. 1 and 2, in order to facilitate an understanding of another embodiment of the invention. It will be recognized that the voltage regulator 100 functions in a manner similar to that described with reference to the voltage regulators 200 and 201 of FIGS. 1 and 2. The regulator 100 includes a control circuit 101 comprising a differentiator 102 having an inverting input 105 receiving a reference voltage $V_{REF}$, a non-inverting input 103 coupled to a feedback node 110 between sense resistors 106, 108, and an output 107 coupled to the control terminal of the power transistor 104. In the simplified circuit of FIG. 100, the low capacity power transistor 204 is not included, inasmuch as the features described make reference to the power transistor 104, and circuitry analogous to the biasing circuitry of FIGS. 1 and 2 is considered to be comprised by the comparator 102.

It has been considered that, by providing high resistance values in the first and second resistors 106, 108, the sensing current $I_2$ required to establish the appropriate voltages across these resistors may be minimized. For example, by establishing the resistance values of the first and second resistors 106, 108 at 1.5 MΩ and 0.5 MΩ, respectively, the sensing current $I_2$ is around 2.5 μA.

In general, such a solution works well in a circuit of the type shown in FIG. 1. However, under certain conditions, simply increasing the value of the voltage divider resistors can create other problems in the circuit. It is known that, under high temperature conditions, transistors such as the power transistor 104 are subject to leakage current, and that the leakage current rises sharply at some threshold temperature. Under normal conditions, the leakage current of the power transistor 104 is well below the level of the sensing current, even at the reduced level indicated above. However, when the transistor 104 is heated to a temperature exceeding a threshold value of, for example, around 150° C., the leakage current of the transistor 104 increases sharply. While the regulator circuit 100 is under load, that is, while there is an additional current $I_1$, the leakage current is compensated for by the control circuitry 101, which merely reduces the level of conduction of the transistor 104 by a value equal to the leakage current.

However, under a no load condition, the transistor 104 is maintained very nearly in a full off condition, already. The sensing current $I_2$ is the only current flowing in the circuit, and is equal to $I_3$. In response to the additional leakage current, the control circuit 101 attempts to completely shut off the transistor 104. However, when the level of the leakage current rises to such a point that it exceeds the sensing current, the voltage levels at the output node 114 and the feedback node 110 rise above their rated levels. Because the control circuit 101 is already in a fully off condition, the transistor 104 cannot be further shut down. Furthermore, the resistance of resistors such as those commonly used for sense resistors 106, 108 tends to rise as the temperature rises, which further increases the voltage seen across these resistors. Under these conditions, the voltage level at the output node 114 may rise significantly.

Figure 5:
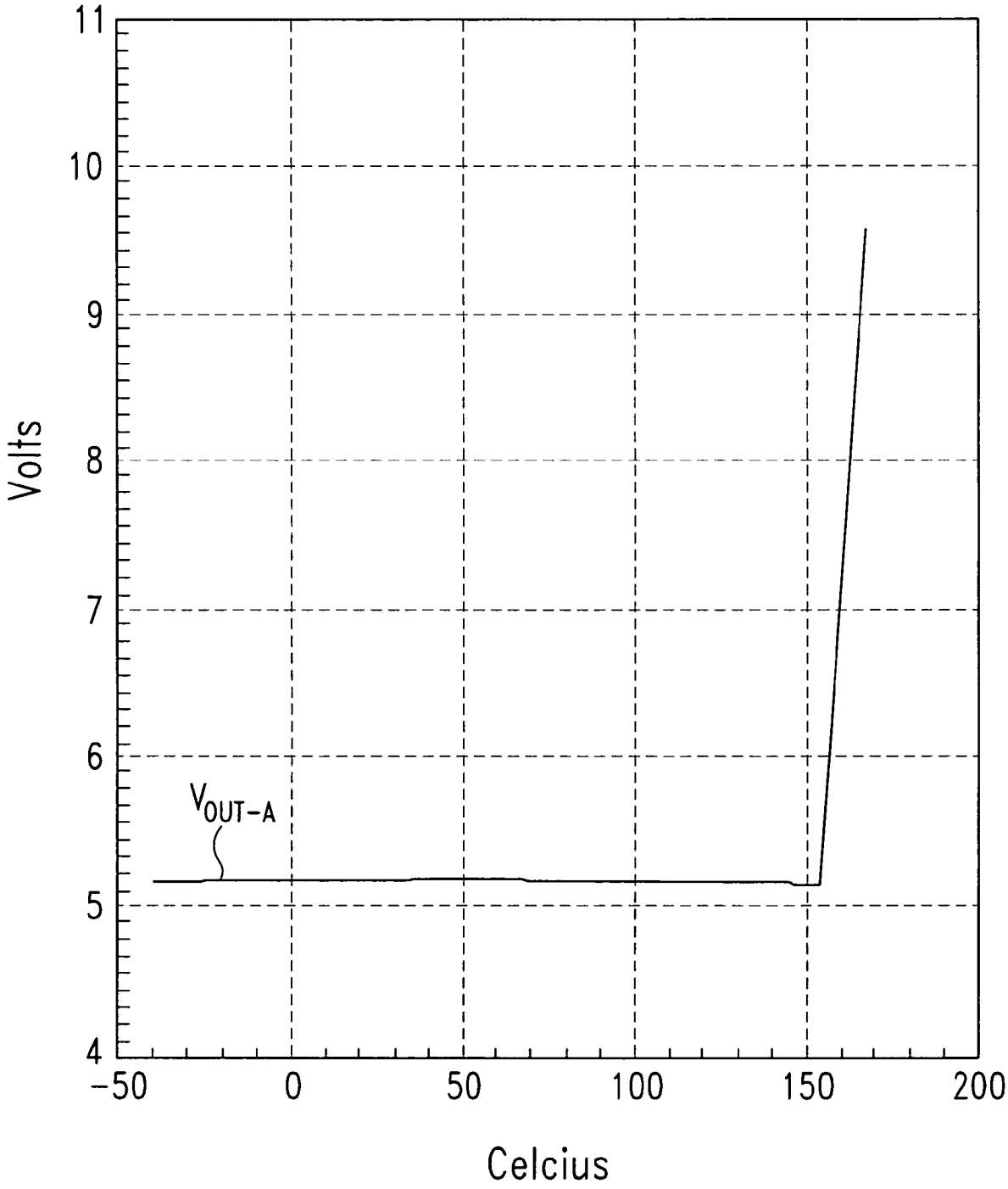
FIG. 5 is a graph illustrating a relationship between temperature and output voltage of the circuit of FIG. 4.

FIG. 5 is a graph showing the output voltage $V_{OUT\text{-}A}$ of a test circuit configured as described above, with a supply voltage of around 12 volts and an output voltage of around 5.04 volts. The graph of FIG. 5 shows the actual output voltage $V_{OUT}$ of such a circuit under no load conditions, in relation to the temperature of the transistor 104. It may be seen that, as the temperature rises above a threshold voltage around 155° C., the output voltage rises sharply.

As was previously described, regulator circuits of the kind described above are commonly used in systems that require a constant voltage supply, even under nominal off conditions of the system. An example provided was that of various automobile systems. In an automobile computer, for example, the memory must be supplied with a constant voltage in order to maintain data in the memory. When the automobile is not operating, most of the functions of the associated computer are also inactive, and very little current is drawn. However, a voltage supply is provided to maintain the memory intact. Because of the scale of integration practiced in modern computers of this type, such computers are very sensitive to fluctuations in input voltage. If such a system were subjected to input voltages rising as high as two to four volts above the rated output voltage, such as shown in FIG. 5, the system would be damaged or destroyed.

The temperature conditions described above are not unusual in such circuits, inasmuch as the normal operating temperatures of high capacity power transistors like transistor 104 of FIG. 4 fall easily within the range of around 150° C., under normal to heavy load conditions. During operation, such temperatures are acceptable, and leakage current is compensated for as previously described. However, when the load is suddenly removed, as when the automobile is turned off, there is a time lag between the time when the load is removed and when the temperature of the circuit drops to a safe level. During this time lag, there is a significant danger of damage to the system, due to excessive output voltage.

Figure 6:
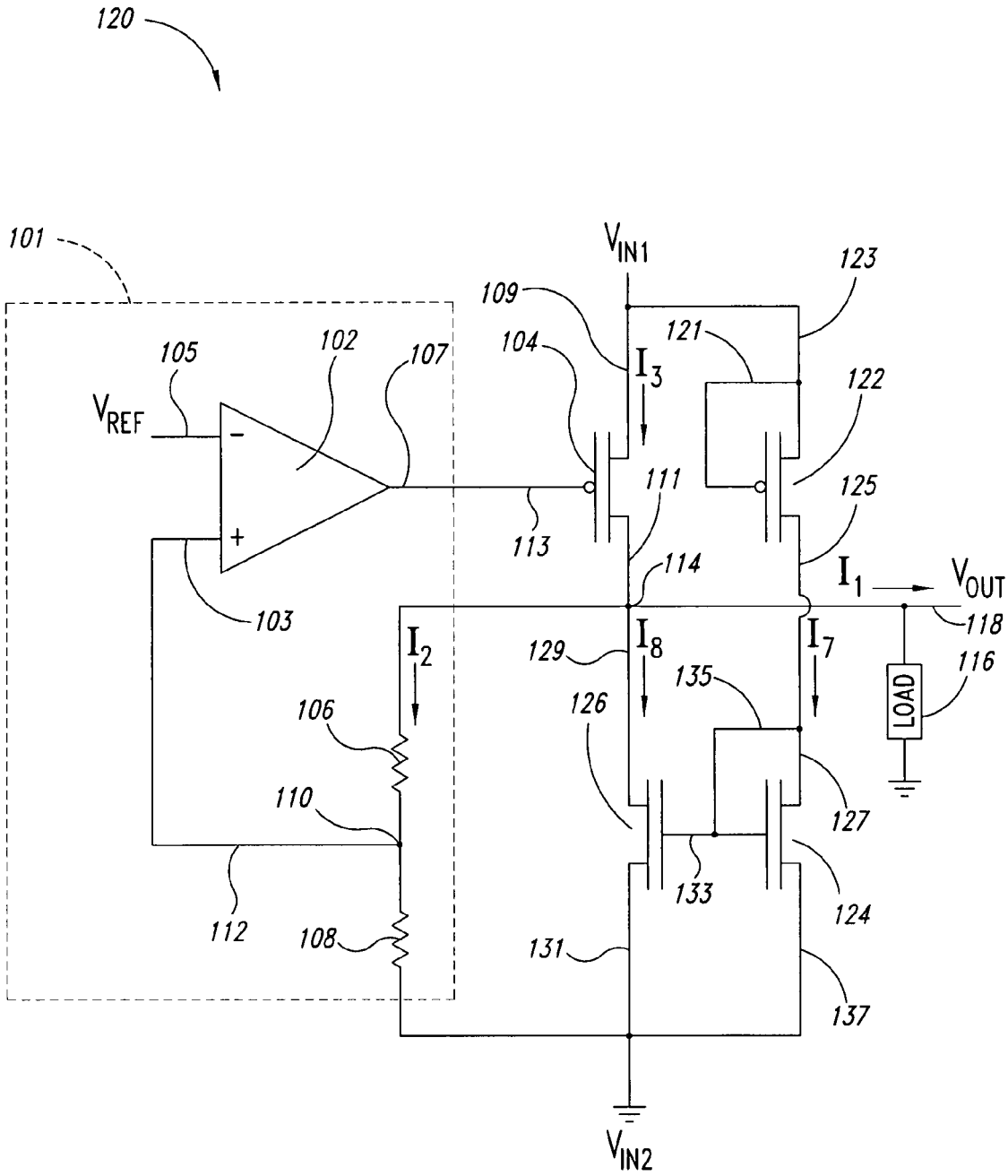
FIG. 6 illustrates a voltage regulator according to another embodiment of the invention.

FIG. 6 illustrates a low quiescent current circuit 120 according to one embodiment of the invention. The features described with reference to the voltage regulator circuit 100 of FIG. 4 that are also found in the voltage regulator circuit 120 of FIG. 6 are indicated with the same reference numerals.

In addition to components previously described, the regulator circuit 120 further includes a second transistor 122 having a first conduction terminal 123 coupled to the input voltage $V_{IN1}$ and a second conduction terminal 125 coupled to a conduction terminal 127 of a third transistor 124. The second transistor 122 has a control terminal 121 coupled to its first conduction terminal 123. It may be seen that the second transistor 122 is configured so as to remain in a permanently off, or non-conducting condition. The third transistor 124 has a second conduction terminal 137 coupled to the circuit ground $V_{IN2}$, and a control terminal 135 coupled to its first conduction terminal 127. A fourth transistor 126 includes a control terminal 133 coupled to the control terminal 135 of the third transistor 124 in a current mirror configuration, with a first conduction terminal 129 coupled to the output node 114 and a second conduction terminal 131 coupled to the circuit ground $V_{IN2}$.

According to an embodiment of the invention, the second transistor 122 is configured and scaled, relative to the first transistor 104, so as to admit a leakage current at a ratio of approximately 1:100, relative to the leakage current of the power transistor 104. In turn, the fourth transistor 126 is configured and scaled, relative to the third transistor 124, so as to mirror the current of the third transistor 124 at a rate of approximately 100:1.

As shown in the embodiment of FIG. 6, the second transistor 122 is a PMOS transistor with its gate terminal coupled to its source terminal. Accordingly, during normal operation of the circuit, the second transistor 122 remains in an off, or non-conducting state. With no current flowing in the current path $I_7$, the diode connected third transistor 124, and the mirror connected fourth transistor 126 are also, therefore, in an off state. Accordingly, there is also no current flowing in the current path $I_8$.

When the temperature of the circuit 120 reaches a point that the power transistor 104 begins to conduct leakage current in path $I_3$, the second transistor 122 also begins to conduct leakage current in path $I_7$. Because of the scaling difference between the first and second transistors 104, 122, the second transistor 122 will leak current at a 1:100 ratio, relative to the leakage current of the first transistor 104. Thus, if the leakage current of the first transistor 104 is equal to 5 μA, the leakage current of the second transistor 122 will be equal to approximately 0.05 μA. When leakage current begins to flow in the second transistor 122, the third transistor 124 turns on to conduct current $I_7$ to ground. In response, the fourth transistor 126 turns on and begins conducting a mirror current $I_8$. Because of the relative scaling of the third and fourth transistors 124, 126, the current $I_8$ flows at a ratio of 100:1 with respect to the current $I_7$. Thus, if the current $I_7$ is equal to 0.05 μA, the current in current path $I_8$ will be equal to approximately 5 μA. In this way, the 5 μA leakage current of the power transistor 104 is shunted from the output node 114 through the fourth transistor 126 to ground. Accordingly, the first and second resistors 106, 108 are not subjected to the leakage current, and the voltage at the output node 114 is maintained at the rated voltage.

According to one embodiment of the invention, the third transistor 124 is scaled much smaller, perhaps an order of magnitude smaller, than the second transistor 122, such that leakage current of its own does not interfere with operation of the system.

Additionally, according to another embodiment of the invention, the fourth transistor 126 is scaled such that, during operation, current $I_8$ is greater than the leakage current flowing in the power transistor 104. In this way, minor variations in the operating characteristics of the transistors of the circuit, arising as a result of normal production manufacturing techniques, do not result in a circuit in which the current $I_8$ is insufficient to shunt all of the leakage current from current $I_3$. A slightly greater current $I_8$ will merely prompt the control circuit 101 to increase conductivity of the power transistor 104 to a very small degree in response.

The second, third, and fourth transistors may be referred to as leakage current control transistors.

Figure 7:
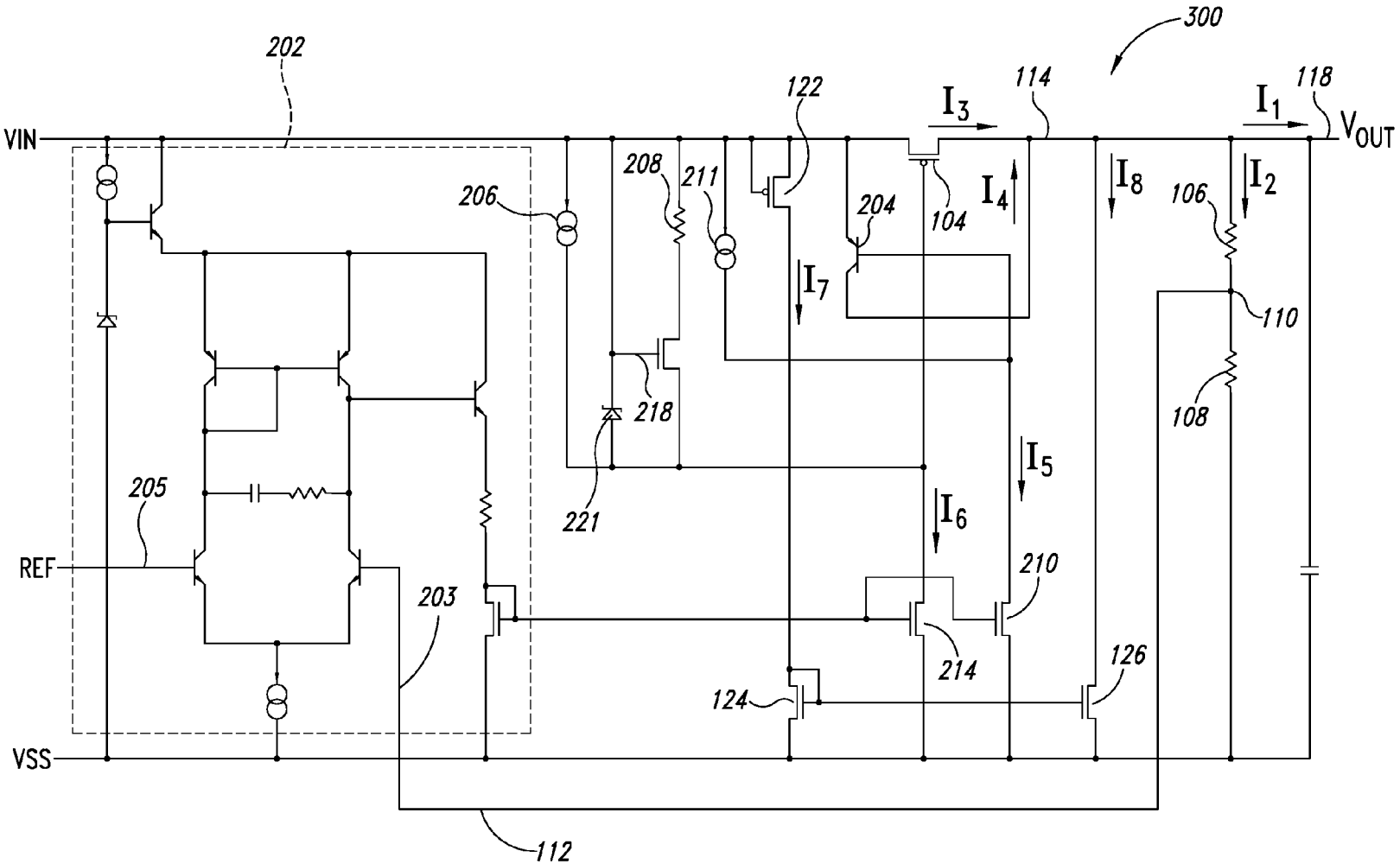
FIG. 7 illustrates a voltage regulator according to a further embodiment of the invention.

Referring now to FIG. 7, a voltage regulator circuit is illustrated in which features of the embodiments illustrated in FIGS. 2 and 6 are combined.

Figure 8A:
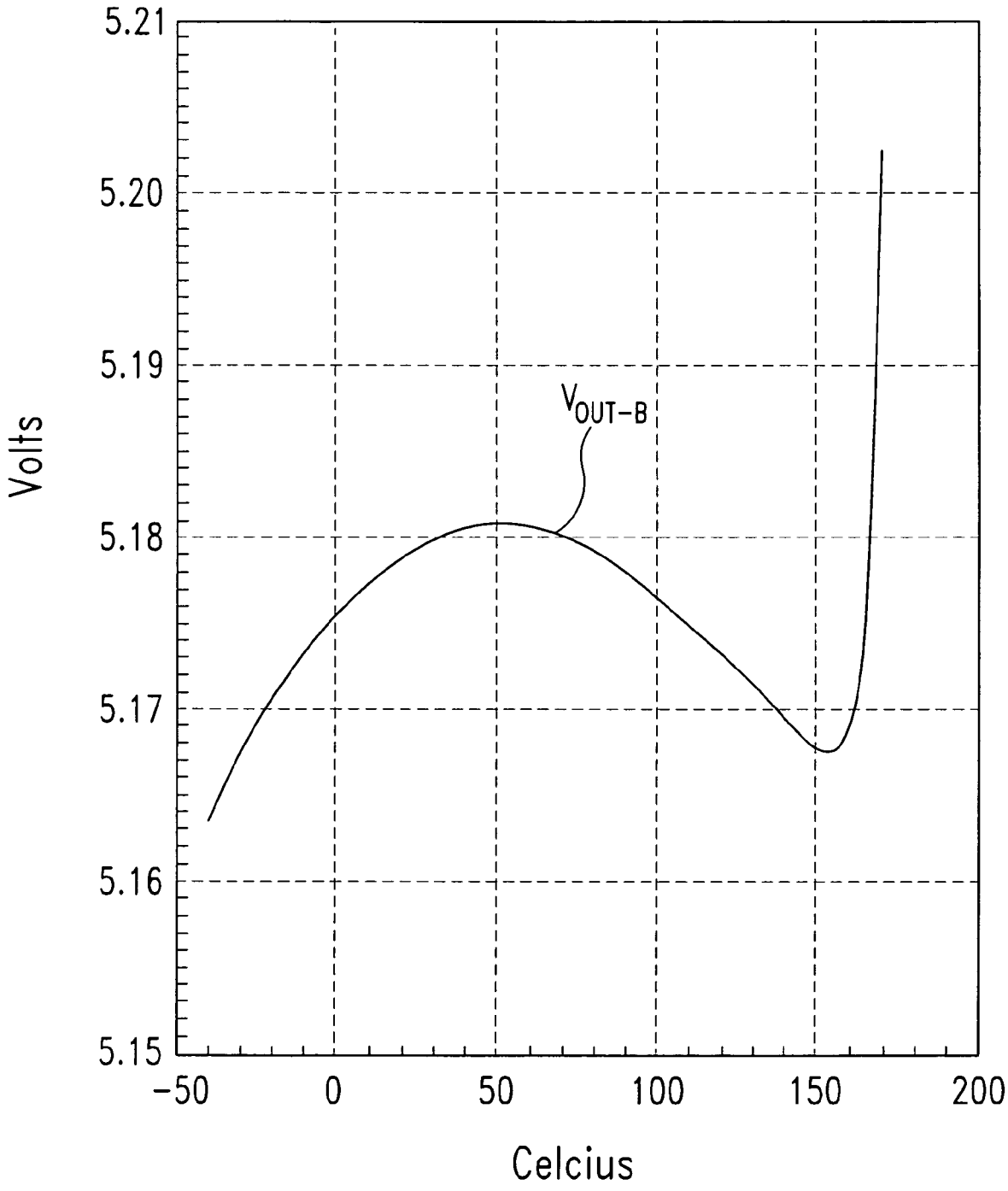
FIG. 8A is a graph illustrating a relationship between temperature and output voltage of the circuit of FIG. 7.

Referring now to FIG. 8A, a graph is illustrated showing the output voltage $V_{OUT-B}$ of a circuit such as that shown in FIG. 7, in which the voltage $V_{OUT-B}$ is shown in relation to the temperature of the circuit. It may be seen that, as the temperature rises, the output voltage $V_{OUT-B}$ remains between 5.16 volts and around 5.18 volts. When the temperature exceeds 155 degrees, the output voltage begins to rise, reaching around 5.2 volts at 170 degrees. Referring again to FIG. 5, it may be seen that this rise corresponds to the rise of the voltage $V_{OUT-A}$, in which the voltage begins to rise at the same point, but rises to around 9.5 volts at 170 degrees.

Figure 8B:
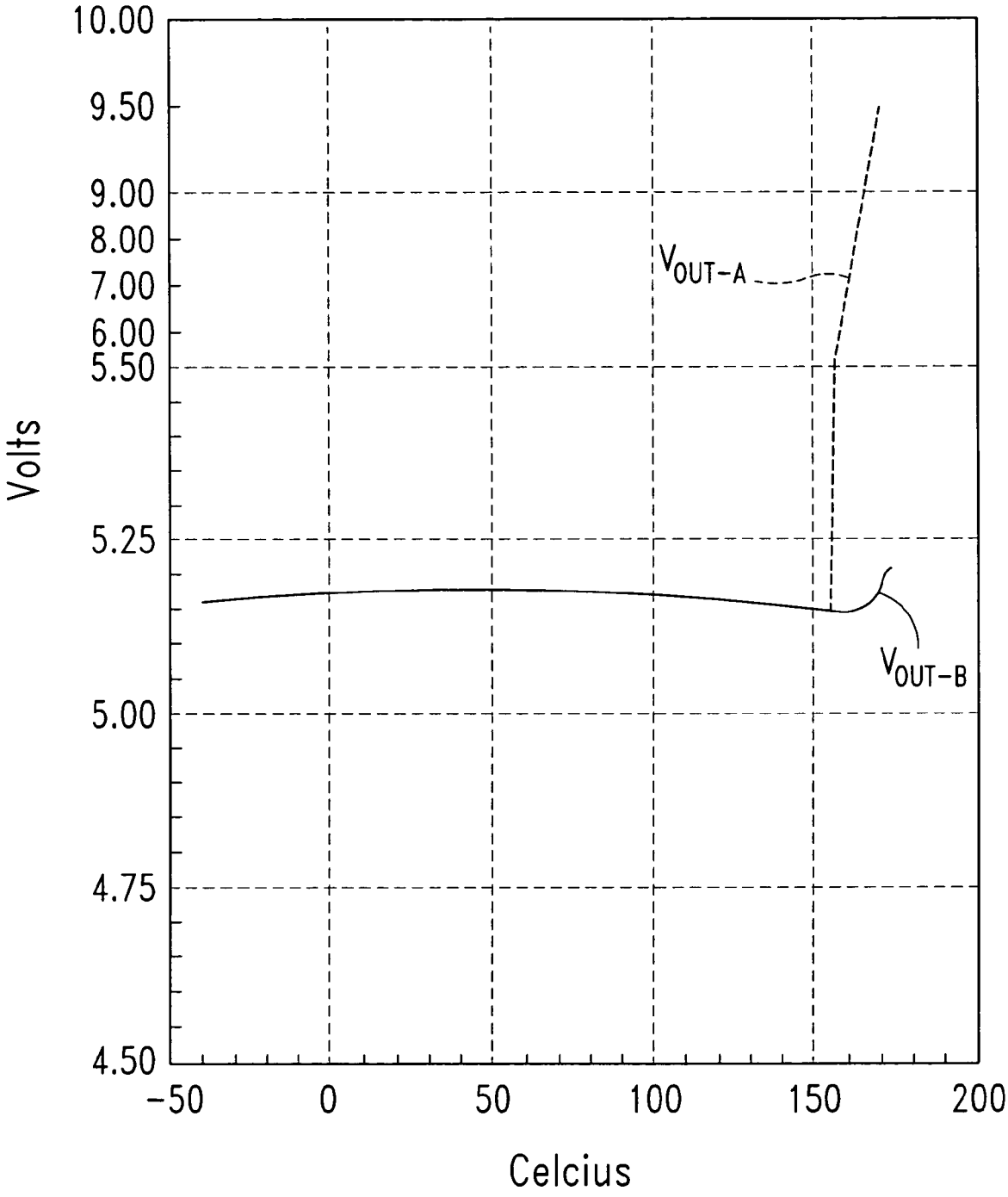
FIG. 8B is a graph comparing the plots of FIGS. 5 and 8A.

Referring to FIG. 8B, the plots of output voltages $V_{OUT-A}$ and $V_{OUT-B}$ are shown on a common chart for easier comparison. It may be seen that, over the range of temperature from 155 to 170 degrees, voltage $V_{OUT-A}$ rises more than 4 volts, while across the same range of temperature, $V_{OUT-B}$ rises less than 0.04 volts.

Figure 9:
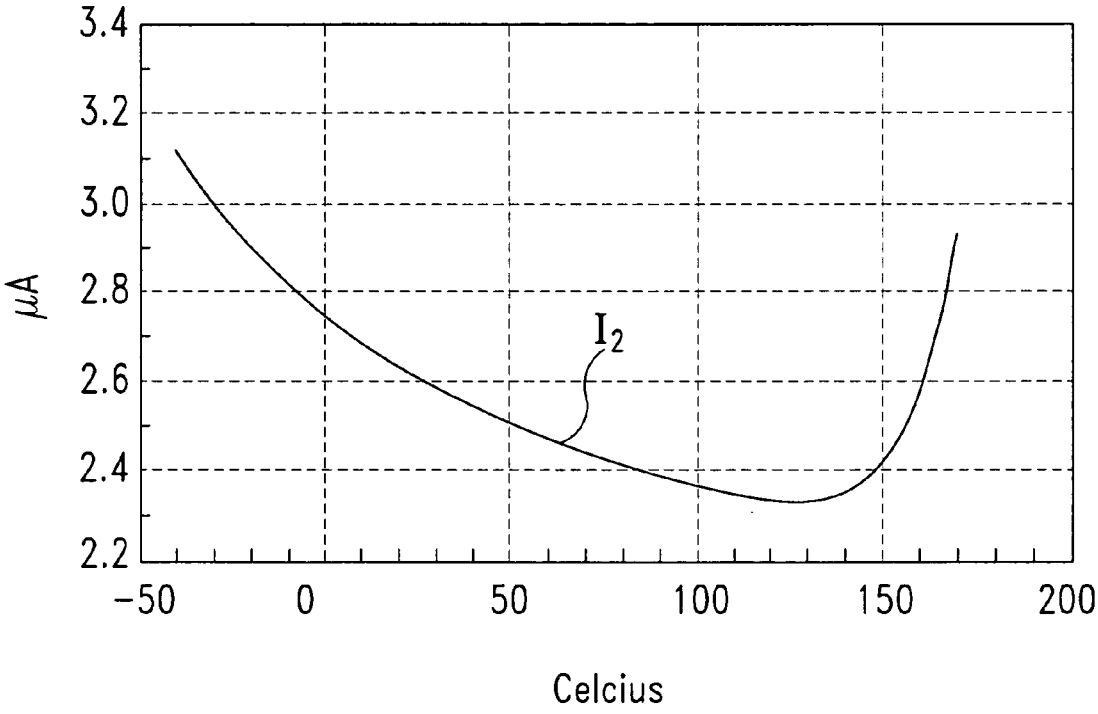
FIG. 9 is a graph illustrating a relationship between temperature and resistance of a component of the circuit of FIG. 7.

FIG. 9, illustrates a plot showing the current $I_2$ flowing through the sensing resistors 106, 108 is shown in relation to temperature in the circuit. It will be recalled that the resistance of the sensing resistors 106, 108 tends to rise with temperature. As a consequence, the current level necessary to maintain a proper sensing voltage at feedback node 110 drops accordingly.

Figure 10:
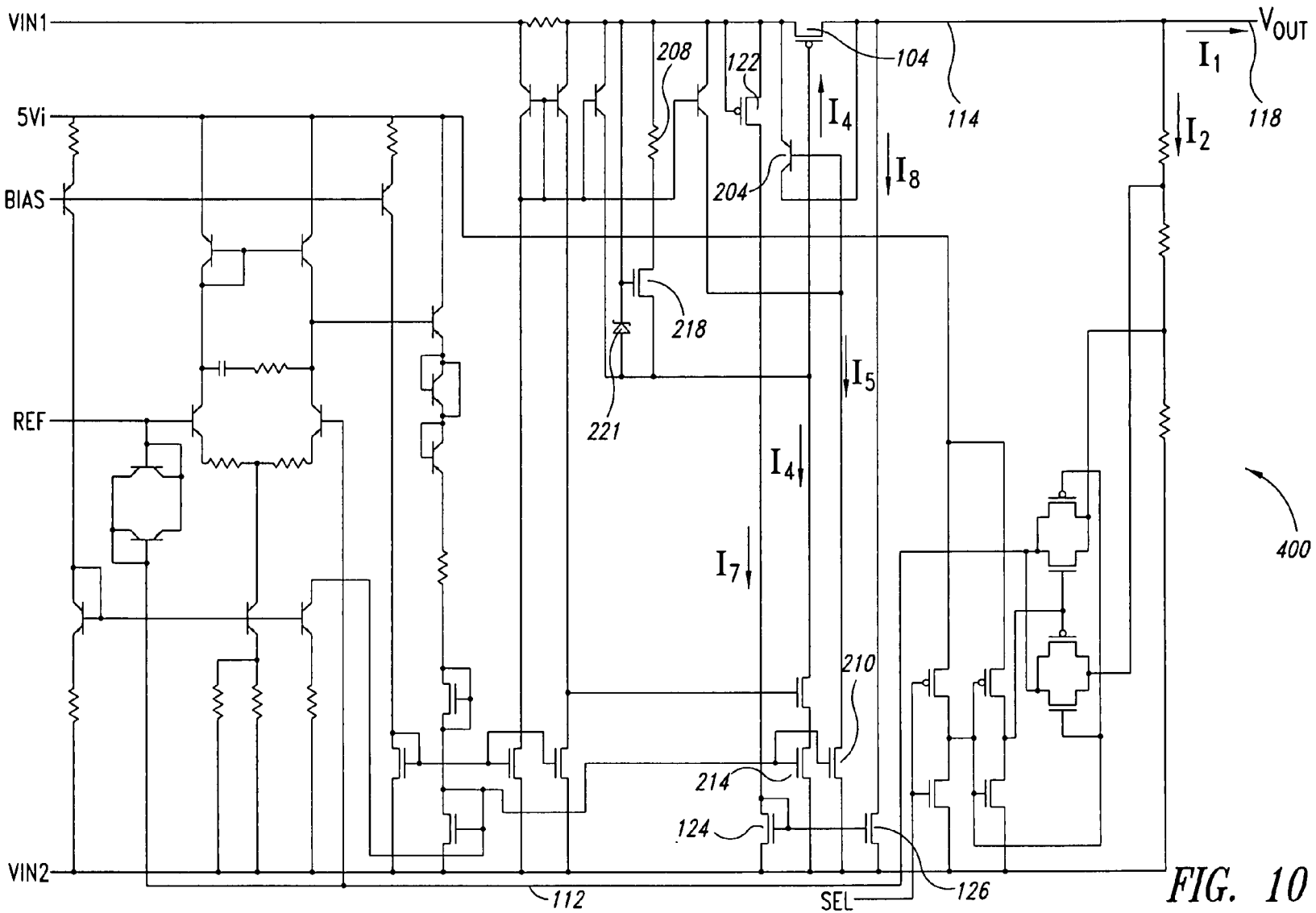
FIG. 10 illustrates a voltage regulator according to a further embodiment of the invention.

Referring now to FIG. 10, a voltage regulator circuit 400 is illustrated, according to an embodiment of the invention, in which the features described with reference to previous embodiments are incorporated.

Figure 11:
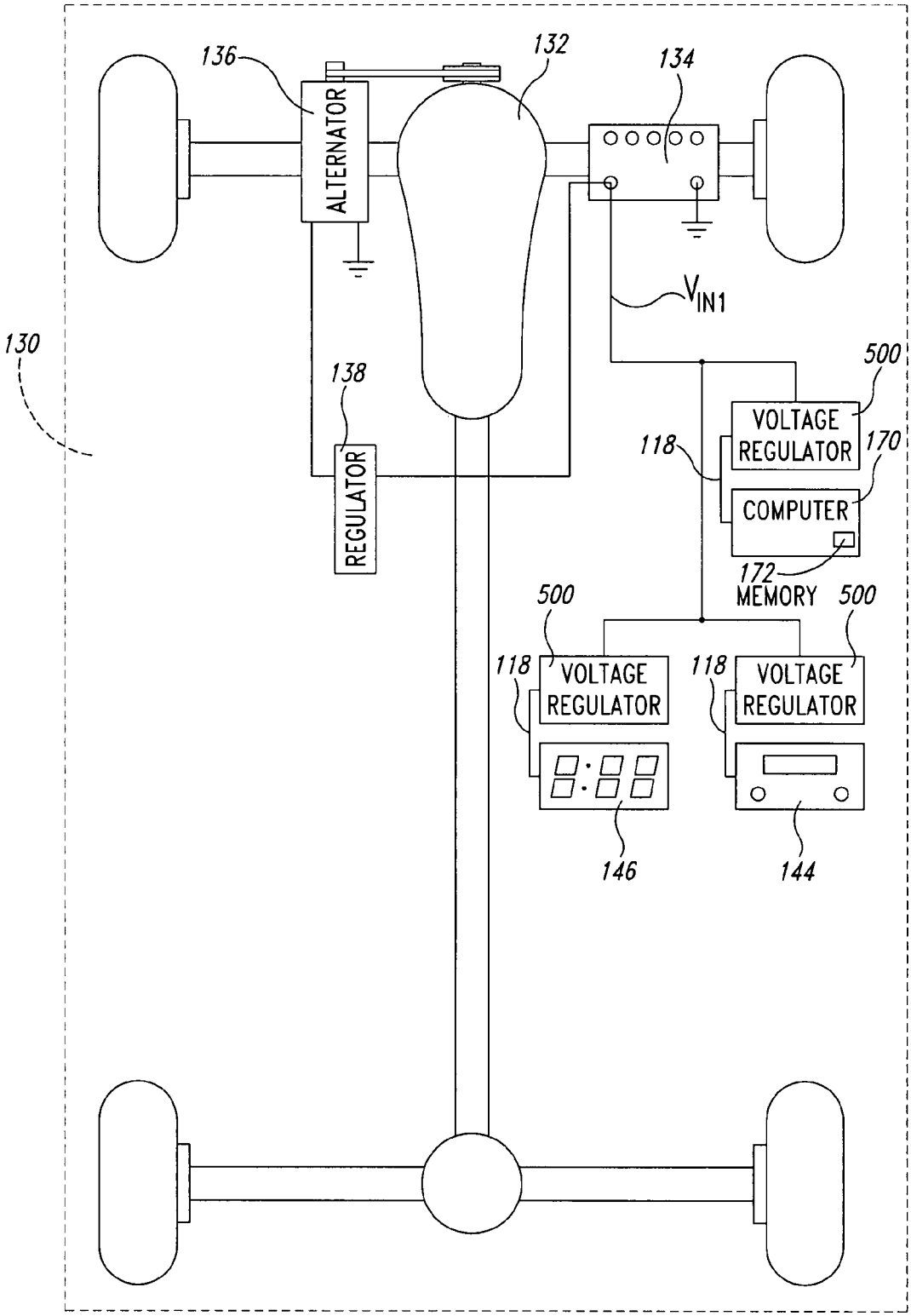
FIG. 11 illustrates an embodiment in which a system employs a voltage regulator according another of the embodiments of the invention.

FIG. 11 shows a vehicle system 130. The system 130 includes an engine 132 and a system battery 134. An alternator 136 and voltage regulation and charging components 138 draw energy from the engine during operation to recharge the battery 134. The system 130 includes various electronic components that must have a continuous voltage supply, even while the rest of the system 130 is not in operation. For example, an onboard computer 170 includes a memory 172 in which are stored various data, including engine performance data and error and malfunction codes. The memory 172 requires a constant regulated voltage source to retain the data in the memory. The system 130 also includes an audio system 144 and a clock 146. Each comprises a volatile memory that depends on a constant regulated voltage source. Accordingly, each component 170, 144, 146 is provided with a voltage regulator 500 employing principles described with reference to disclosed embodiments of the invention.

It will be recognized that each of the voltage regulators 500 of FIG.11 may be integrated with the respective component 170, 144, 146, or may be provided as a discrete component. Alternatively, a single regulator 500 may be provided to supply a regulated voltage supply to a plurality of system components.

While the system 130 is shown in FIG. 11 as an automobile, the system 130 may be any device that includes components that require an uninterrupted voltage supply, even while other components of the system are inactive, especially systems that employ batteries for primary or auxiliary power. For example, such alternate systems may include other vehicles such as a boat or airplane, smaller devices such as notebook computers, PDA's, handheld games, solar powered monitoring systems, communications equipment, etc.

One having ordinary skill in the art will recognize many variations and modifications of the embodiments described herein. For example, the gain factors and relative operating ratios of the various transistors, and the output and reference voltage levels, may be adjusted according to design considerations of particular circuits and particular requirements. While the transistors described with reference to various embodiments are shown as being of particular configurations and conductivity types, it is well within the abilities of one having ordinary skill in the art to design a circuit that is functionally similar to the voltage regulator circuit 120, using other types of active devices, and devices having different conductivity characteristics. Some regulator circuits may require additional power transistors to supply a required current load. All such variations and modifications are considered to fall within the scope of the invention.

Values of particular parameters such as turn-on thresholds of the power transistors, current suppression threshold of the biasing resistor circuit, biasing levels, current capacities, etc, are dictated by requirements of particular applications, and may be established without undue experimentation.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A voltage regulator, comprising:

an output node configured to be coupled to a load circuit;

a first power transistor having a first conduction terminal coupled to a voltage source and a second conduction terminal coupled to the output node;

a second power transistor having a control terminal, a first conduction terminal coupled to the voltage source, and a second conduction terminal coupled to the output node; and a control circuit configured to sense an output voltage at the output node and provide control signals to control a conduction capacity of each of the first and second power transistors such that the output voltage remains approximately equal to a selected output voltage, the control circuit further configured to hold the second transistor in an off state unless a load current drawn from the output node exceeds a threshold current, the control circuit having:

a biasing transistor coupled between the control terminal of the second power transistor and a circuit ground, and a biasing resistor circuit coupled between the first voltage source and the control terminal of the second power transistor and having a biasing resistance configured to vary inversely relative to a biasing current flowing therethrough.

2. The voltage regulator of claim 1 wherein the first power transistor is a bipolar transistor and the second power transistor is a MOS type transistor.

3. The voltage regulator of claim 1 wherein the control circuit comprises:

an additional biasing transistor coupled between the circuit ground and a control terminal of the first power transistor and configured to regulate a biasing current of the first power transistor; and first and second constant current sources coupled between the voltage source and respective control terminals of the first and second power transistors.

4. The voltage regulator of claim 3 wherein biasing transistor and the additional biasing transistor are MOS type transistors.

5. The voltage regulator of claim 3 wherein the biasing resistor circuit comprises the second constant current source.

6. The voltage regulator of claim 5 wherein the biasing resistance comprises a transistor coupled between a resistor and the control terminal of the second power transistor, the transistor having a control terminal coupled to the voltage source.

7. The voltage regulator of claim 6 wherein the biasing resistor circuit comprises a zener diode coupled between the control terminals of the transistor of the biasing resistance and the second power transistor.

8. A voltage regulator, comprising:

an output node configured to be coupled to a load circuit;

a first power transistor having a first conduction terminal coupled to a voltage source and a second conduction terminal coupled to the output node;

a second power transistor having a first conduction terminal coupled to the voltage source and a second conduction terminal coupled to the output node;

a control circuit configured to sense an output voltage at the output node and provide control signals to control a conduction capacity of each of the first and second power transistors such that the output voltage remains approximately equal to a selected output voltage, the control circuit further configured to hold the second transistor in an off state unless a load current drawn from the output node exceeds a threshold current;

a first leakage current control transistor having first and second conduction terminals, the first conduction terminal being coupled to the voltage source;

a second leakage current control transistor having a control terminal and a first conduction terminal coupled to the second conduction terminal of the first leakage current control transistor and a second conduction terminal coupled to the circuit ground; and a third leakage current control transistor having first and second conduction terminals coupled to the output node and the circuit ground, respectively, and a control terminal coupled to the control terminal of the second leakage current control transistor in current mirror configuration.

9. The voltage regulator of claim 8 wherein the first leakage current control transistor has current leakage characteristics correlated to current leakage characteristics of the second power transistor.

10. A device, comprising:

a load circuit having a voltage input coupled to a regulated voltage output node and configured to receive a voltage supply at a first voltage level;

a sensing circuit configured to sense a voltage level at the regulated voltage output node;

a first transistor configured to regulate current flow from a voltage source to the output node and configured to have a maximum conduction capacity exceeding a current flow necessary for operation of the sensing circuit;

a second transistor configured to regulate current flow from the voltage source to the output node and configured to have a maximum conduction capacity exceeding a maximum current level requirement of the load circuit; and a control circuit configured to receive a sensed voltage level signal from the sensing circuit and control conduction of the first transistor such that it conducts when the sensed voltage level drops below a first threshold, the control circuit further configured to control conduction of the second transistor such that it remains in an off condition unless the sensed voltage level drops below a second threshold, the control circuit having a biasing network coupled between the voltage source and a circuit ground with a control node coupled to a control terminal of the second transistor, the biasing network having a first biasing element coupled between the voltage source and the control node and a second biasing element coupled between the control node and the circuit ground, the first and second biasing elements being arranged as a voltage divider between the voltage source and the circuit ground and configured to hold the second transistor in the off condition while the sensed voltage level is above the second threshold and to turn on the second transistor when the sensed voltage level is below the second threshold, the biasing network further configured to at least partially suppress a biasing current passing therethrough while the sensed voltage level is above the second threshold.

11. The device of claim 10 wherein the first threshold is equal to the first voltage level.

12. The device of claim 10 wherein the control circuit comprises an additional biasing network configured to provide a bias vo1tage at a conduction terminal of the first transistor.

13. The device of claim 10, further comprising a bypass circuit configured to shunt leakage current flowing in the second transistor away from the sensing circuit.

14. The device of claim 10 wherein the first element of the biasing network comprises:

a transistor;

a resistor coupled in series with the transistor between the transistor and the voltage source; and a constant current source coupled between the voltage source and the control node in parallel with the series-connected transistor and resistor.

15. A voltage regulator, comprising:

a first transistor formed on a semiconductor substrate, having first and second conduction terminals coupled to a first voltage source and an output node, respectively;

a control circuit configured to monitor a voltage level at the output node and provide a control signal at a control terminal of the first transistor so as to maintain the voltage level at a selected value;

a second transistor formed on the substrate, having first and second conduction terminals, the first conduction terminal being coupled to the first voltage source;

a third transistor formed on the substrate, having a first conduction terminal and a control terminal coupled to the second conduction terminal of the second transistor, and a second conduction terminal coupled to a second voltage source;

a fourth transistor formed on the substrate and having first and second conduction terminals coupled to the output node and the second voltage source, respectively, and a control terminal coupled to the control terminal of the third transistor.

16. The regulator of claim 15 wherein the control circuit comprises:

first and second sensing resistors coupled in series between the output node and the second voltage source; and a comparator circuit having a first input coupled to receive a reference voltage, a second input coupled to a sensing node at a connection point between the first and second resistors, and an output coupled to the control terminal of the first transistor.

17. The regulator of claim 16 wherein a total resistance of the first and second sensing resistors is approximately 2 MΩ.

18. The regulator of claim 15, wherein the second transistor is configured to leak current at a selected ratio, relative to current leakage of the first transistor, across a selected range of temperatures.

19. The regulator of claim 18, wherein the selected ratio is 1:100.

20. The regulator of claim 18 wherein the fourth transistor is configured to mirror a current flowing in the third transistor at a ratio substantially reciprocal to the leakage current ratio of the second transistor relative to the first transistor.

21. The regulator of claim 15 wherein the fourth transistor is configured to mirror a current flowing in the third transistor at a selected ratio.

22. The regulator of claim 21 wherein the selected ratio is 100:1.

23. The regulator of claim 15 wherein the first and second transistors are PMOS type transistors.

24. The regulator of claim 15 wherein the third and fourth transistors are NMOS type transistors.

25. The voltage regulator of claim 15 wherein the second transistor is configured to be biased in an off state while the voltage regulator is in operation.

26. A device, comprising:

a first transistor configured to regulate current flow to an output node;

a sensing circuit configured to sense a voltage level at the output node;

a control circuit configured to control conduction of the first transistor according to a voltage level at an sensing node of the sensing circuit; and a bypass circuit configured to shunt leakage current flowing in the first transistor away from the sensing circuit.

27. The device of claim 26 wherein the bypass circuit comprises:

a second transistor configured to leak current at a first ratio relative to the current leakage of the first transistor;

a third transistor coupled, in diode configuration, in series with the second transistor; and a fourth transistor configured to mirror a current flowing in the third transistor at a second ratio, relative to the current flowing in the third transistor, substantially reciprocal to the first ratio.

28. The device of claim 27 wherein the second ratio is selected to compensate for uncontrolled variables in processes of manufacture of the device.

29. The device of claim 27 wherein the second ratio is selected to compensate for current losses due to leakage in the third transistor.

30. A regulator circuit, comprising:

a first transistor having a first maximum current capacity configured to regulate current flow to an output node;

a second transistor having a second maximum current capacity, greater than the first maximum current capacity, configured to regulate current flow to the output node;

means for sensing a voltage level at the output node and providing control signals at control terminals of the first and second transistors such that voltage at the output node is maintained substantially at a selected level and the second transistor remains in an off state while a demand for current at the output node remains below an output threshold; and means for shunting leakage current of the second transistor away from the sensing means.

31. The regulator circuit of claim 30, comprising means for at least partially suppressing an increase of current in a biasing network of the second transistor while the control signal at its control terminal is below a bias threshold.

32. A regulator circuit, comprising:

a transistor configured to regulate current flow to an output node;

means for sensing a voltage level at the output node and providing a control signal at a control terminal of the transistor such that voltage at the output node is maintained at a selected level; and means for shunting leakage current of the transistor away from the sensing means.

33. The regulator circuit of claim 32 wherein:

the transistor is a first transistor;

the shunting means includes a second transistor configured to leak, through a path separate from the output node, a current at a first ratio equal to or less than unity, relative to the leakage current of the first transistor; and a third transistor configured to mirror, through a path parallel to the sensing means, the current of the path separate from the output node at a second ratio at least equal to a reciprocal of the first ratio.

34. The regulator circuit of claim 32 wherein the shunting means further comprises a fourth transistor coupled, in diode configuration, in the current path separate from the output node, and wherein a control terminal of the third transistor is coupled to a control terminal of the fourth transistor in current mirror configuration.

35. A method, comprising:

measuring a voltage level at an output node of a voltage regulator circuit;

increasing conduction capacity of a first transistor, configured to conduct a first current between a voltage source and the output node, if the measured voltage level is below a first selected voltage level; and increasing conduction capacity of a second transistor, configured to conduct a second current between the voltage source and the output node, if the measured voltage level is below a second selected voltage level, the increasing step including drawing a third current through a path including a resistor coupled to a control terminal of the second transistor, the resistor configured to vary in resistance inversely with a level of the third current.

36. The method of claim 35, further comprising suppressing, at least partially, the third current, if the measured voltage level is not below the second selected voltage level.

37. A method, comprising:

controlling a voltage level at an output node of a regulator circuit by providing a control signal to first transistor coupled between the output node and a voltage supply; and shunting a current substantially equal to a leakage current of the first transistor from the output node to a circuit ground.

38. The method of claim 37 wherein the shunting step comprises:

leaking a current through a second transistor at a first ratio, relative to the leakage current of the first transistor; and mirroring, at a second ratio substantially reciprocal to the first ratio, the leakage current of the second transistor in a third transistor coupled between the output node and the circuit ground.

39. A system, comprising:

a voltage regulator including a first power transistor configured to regulate current flow to an output node, a control circuit configured to sense a voltage level at the output node and provide a control signal at a control terminal of the first power transistor such that voltage at the output node is maintained at a selected level, and a bypass circuit configured to shunt current at least equal to a leakage current of the first power transistor away from the sensing means; and a load circuit configured to draw current at the selected voltage level from the output node.

40. The system of claim 39, further comprising an automobile, and wherein the voltage regulator is configured to regulate voltage from a power supply of the automobile, including a battery, to the load, and wherein the load is a subsystem of the automobile.

41. The system of claim 39 wherein the first power transistor is one of a plurality of power transistors configured to regulate current flow to the output node, and wherein the control circuit is configured to provide control signals at control terminals of each of the plurality of power transistors such that current flow above a threshold is regulated, at least in part, by the first power transistor, and current flow below the threshold is regulated entirely by a second one of the plurality of power transistors.

42. The system of claim 39 wherein the load circuit is selected from among a computer, a component of an audio system, and a clock.

43. A device, comprising:

a load circuit having a voltage input coupled to a regulated voltage output node and configured to receive a voltage supply at a first voltage level;

a sensing circuit configured to sense a voltage level at the regulated voltage output node;

a first transistor configured to regulate current flow from a voltage source to the output node and configured to have a maximum conduction capacity exceeding a current flow necessary for operation of the sensing circuit;

a second transistor configured to regulate current flow from the voltage source to the output node and configured to have a maximum conduction capacity exceeding a maximum current level requirement of the load circuit;

a control circuit configured to receive a sensed voltage level signal from the sensing circuit and control conduction of the first transistor such that it conducts when the sensed voltage level drops below a first threshold, the control circuit further configured to control conduction of the second transistor such that it remains in an off condition unless the sensed voltage level drops below a second threshold; and a bypass circuit configured to shunt leakage current flowing in the second transistor away from the sensing circuit.

44. The device of claim 43 wherein the bypass circuit includes a third transistor configured to admit a leakage current at a selected ratio relative to the leakage current flowing in the second transistor and a fourth transistor coupled in parallel with the sensing circuit, the fourth transistor being configured to mirror a current flowing in the third transistor at a ratio approximately reciprocal to the selected ratio.

* * * * *